US007767944B2

(12) United States Patent
Facciano et al.

(10) Patent No.: US 7,767,944 B2
(45) Date of Patent: Aug. 3, 2010

(54) PIEZOELECTRIC FIBER, ACTIVE DAMPED, COMPOSITE ELECTRONIC HOUSINGS

(75) Inventors: Andrew B. Facciano, Tucson, AZ (US); Robert T. Moore, Tucson, AZ (US); Gregg J. Hlavacek, Tucson, AZ (US); Craig D. Seasly, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 751 days.

(21) Appl. No.: 11/715,034

(22) Filed: Mar. 7, 2007

(65) Prior Publication Data

US 2008/0217465 A1 Sep. 11, 2008

(51) Int. Cl.
*F41G 7/00* (2006.01)
*F42B 15/10* (2006.01)

(52) U.S. Cl. ..... 244/3.1; 244/3.15; 102/293; 102/374

(58) Field of Classification Search ..... 102/374, 102/377, 293; 244/3.1, 3.15
See application file for complete search history.

(56) References Cited

U.S. PATENT DOCUMENTS

| | | | | |
|---|---|---|---|---|
| 2,945,380 | A | 7/1960 | Pope et al. | |
| 3,908,933 | A | 9/1975 | Gross et al. | |
| 4,400,642 | A | 8/1983 | Kiraly | |
| 4,715,283 | A | 12/1987 | Yengst | |
| 4,793,571 | A * | 12/1988 | Kranz | 244/3.1 |
| 4,845,357 | A | 7/1989 | Brennan | |
| 4,922,096 | A * | 5/1990 | Brennan | 244/3.16 |
| 6,563,250 | B2 * | 5/2003 | Mathur | 310/316.01 |
| 6,620,287 | B2 | 9/2003 | Cass | |
| 6,752,020 | B1 | 6/2004 | Sobotta et al. | |
| 7,081,701 | B2 * | 7/2006 | Yoon et al. | 310/369 |
| 7,608,985 | B2 * | 10/2009 | Sanderson | 310/338 |
| 2008/0140316 | A1 | 6/2008 | Masson | |

OTHER PUBLICATIONS

"International Application Serial No. PCT/US2008/008291, International Search Report mailed Mar. 6, 2009", P220.
"International Application Serial No. PCT/US2008/008291, Written Opinion mailed Mar. 6, 2009", P237.

* cited by examiner

*Primary Examiner*—James S Bergin
(74) *Attorney, Agent, or Firm*—Schwegman, Lundberg & Woessner P.A.; Gregory J. Gorrie

(57) ABSTRACT

A vibration controlled housing. The novel housing includes a housing structure and a mechanism for receiving a control signal and in accordance therewith electronically tuning a structural response of the structure. In an illustrative embodiment, the housing structure includes a composite material containing a plurality of piezoelectric fibers adapted to generate an electrical signal in response to a deformation in the structure and to deform the structure in response to an electrical signal applied thereto. A control circuit receives the sensed signal from the fibers and generates an excitation signal that is applied to the fibers to increase the stiffness or compliance of the fibers at predetermined frequencies. In an illustrative embodiment, the control signal is adapted to provide low frequency stiffness and strength performance while attenuating high frequency vibrations to protect electronics housed within the structure.

23 Claims, 7 Drawing Sheets

PIEZOELECTRIC FIBER, ACTIVE DAMPED, COMPOSITE ELECTRONIC HOUSINGS

BACKGROUND OF THE INVENTION

1. Field of the Invention

The present invention relates to systems and methods for controlling vibration. More specifically, the present invention relates to systems and methods for suppressing vibrations in missiles.

2. Description of the Related Art

In very dynamic environments, missiles are typically subject to severe vibration and shock during launch egress, flight ascent, and stage separation. If these vibration and shock loads are not mitigated, various system components may be damaged, causing the missile to fail.

Mission success requires that the missile be able to keep the target in its field-of-view while it maneuvers itself into a position to intercept the target. A primary disturbance to the missile is the divert thrust delivered by the propulsion system. This thrust force tends to deform the missile into a beam bending mode at its first natural frequency. If the missile frequency modes (including the seeker frequency mode) have natural periods less than or on the same order as the divert thruster rise time, then significant dynamic amplification and airframe ringing will occur.

The dynamic amplification and the airframe ringing or vibration response make target tracking particularly difficult as the optical elements within the seeker will move relative or out of phase to each other producing significant seeker line-of-sight (LOS) motion. Seeker pixel resolution can be maximized by providing a very rigid missile airframe to minimize the jitter transmitted to the seeker platform.

A missile must also be able to accurately determine its own position in order to compute a flight path to intercept the target. Missiles typically include a guidance system that relies on an inertial measurement unit (IMU) to determine the position of the missile by measuring its acceleration and rotation. The IMU is extremely sensitive and should be very rigidly and precisely mounted to the missile airframe, which should also be very stiff. Otherwise, the IMU will move around and make inaccurate measurements, causing the missile to tumble out of control. The entire forebody assembly should therefore be made as stiff as possible to provide a stable platform for the IMU.

Unfortunately, airframe stiffening for better IMU and seeker performance can lead to undesirable transmission of high frequency vibration and shock loads due to rocket motor ignition, stage separations, aerodynamic buffeting, and acoustic loading. If these vibration loads are coupled to the electronic components, the electronics may be critically damaged, leading to missile failure. In addition, structural stiffening typically results in greater mass and weight, which affects the maneuverability and range of the missile.

Efforts to make the structure more compliant—for example, by using rubber mounts to isolate the electronic components—may attenuate the high frequency vibrations, but excessive structural compliance may disable accurate IMU displacement and rotational readings with respect to the missile trajectory. A significant challenge that is faced when packaging electronics equipment is therefore the trade off between providing sufficient isolation from separation and divert shock loading, versus sufficient stiffness to enable IMU platform functionality, while still meeting strength and weight requirements.

In addition, missile systems must typically be designed to attenuate flexible body dynamics or the system could have self-exciting vibrations. In the case where these vibrations are not bounded, catastrophic structural damage and mission failure may occur. In the case where the vibrations remain finite, the additional frequency content in the actuator commands can lead to actuator failure due to overheating and mission failure. Currently, digital notch filters are used to attenuate the effects of the lower frequency modes (1st, and 2nd lateral modes, 1st torsional, and fin modes) and low-pass filters to attenuate the effects of the higher frequency modes. A problem with this approach is that the use of digital filters results in phase loss at low frequencies, which limits the robust performance of the flight control system. The notches associated with the 1st lateral body mode are usually the lowest frequency modes and have the greatest impact on robust performance of the flight control system.

The traditional approach to these problems is to physically tune the structural responses of the missile components and assemblies (including the electronics housings and mounting structures, as well as the airframe and airframe joints) to mitigate these vibration loads. This process typically involves iterative, long term dynamic analyses of the individual components and assemblies. This highly detailed FEM analysis results in dynamic transfer functions incorporated into system guidance simulation evaluations, where further optimization is usually necessary, resulting in tuning requirements for the airframe again per analysis, iterating the transfer function and simulation studies. Several different designs may be constructed and tested at great expense before a satisfactory design is found. This procedure has proven to be extremely time consuming, wrought with errors, and has led to, significant program development schedule slippages and cost overruns.

Hence, a need exists in the art for an improved system or method for mitigating missile vibration loads that is simpler, less expensive, and less time consuming than prior approaches.

SUMMARY OF THE INVENTION

The need in the art is addressed by the vibration controlled housing of the present invention. The novel housing includes a housing structure and a mechanism for receiving a control signal and in accordance therewith electronically tuning a structural response of the housing structure.

In the illustrative embodiment, the housing structure includes a composite material containing a plurality of piezoelectric fibers adapted to generate an electrical signal in response to a deformation in the structure and to deform the structure in response to an electrical signal applied thereto. A control circuit receives the sensed signal from the fibers and generates an excitation signal that is applied to the fibers to increase the stiffness or compliance of the fibers at predetermined frequencies.

In accordance with the present teachings, piezoelectric fiber composites are integrated into the missile airframe, seeker housing, guidance system housing, and missile mounting structures of a missile to control various vibration loads. In an illustrative embodiment, the control signal is adapted to increase compliance of the fibers at high frequencies to dampen high frequency vibrations to, protect system electronics, while at the same time increase stiffness of the fibers at low frequencies to provide a stable platform for the seeker and guidance system.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

The present teachings provide a novel vibration control method that integrates piezoelectric composite technology into missile components. Piezoelectric composites generate electricity when they are flexed, and flex when a current or electric field is applied. Using this technology, signals from a flexing composite part can be used by an integrated circuit (IC) to send back an excitation signal that the composite will respond to, attenuating and dampening the vibration. This has a net strengthening effect. In addition to vibration control, constructing missile components using piezoelectric composites can help weight optimization efforts by allowing lighter designs to achieve the same strength as non-attenuated designs. Also, the ability to use an integrated circuit engineered to feedback a current which induces a response in the composite gives the ability to fine tune and tailor the feedback so that certain vibration frequencies or frequency ranges can be focused on for attenuation.

Figure 1A:
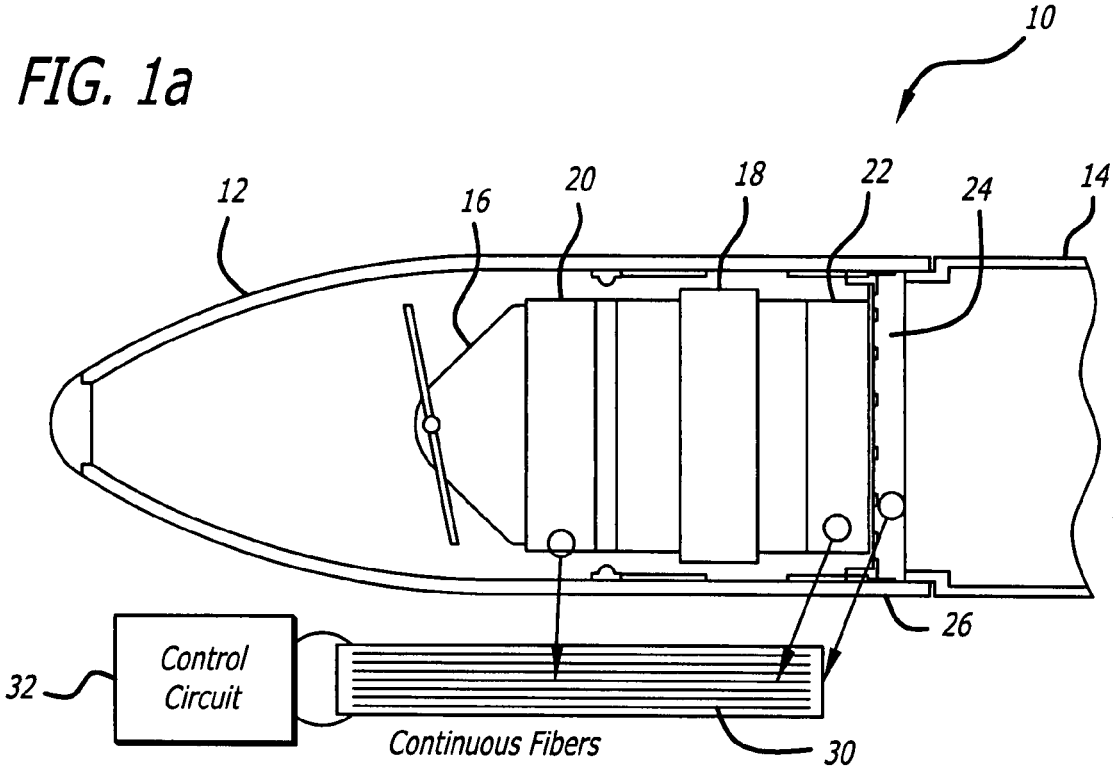
FIG. 1*a* is a cross-sectional view of a missile with a vibration control system designed in accordance with an illustrative embodiment of the present invention.

FIG. 1*a* is a cross-sectional view of a missile 10 with vibration controlled components designed in accordance with an illustrative embodiment of the present invention. The missile 10 includes a forebody assembly 12 that is forward of the missile warhead and/or rocket motor 14. The forebody assembly 12 includes a seeker assembly 16 and guidance system 18. The seeker electronics of the seeker assembly 16 are housed in a novel electronics housing 20, which contains piezoelectric fiber composite sensor/actuators 30 for electronically tuning the structural response of the housing 20 in accordance with the teachings of the present invention. Similarly, the electronics modules of the guidance system 18 are housed in an electronics housing 22 that contains piezoelectric fiber composite sensor/actuators 30.

The missile forebody 12 also includes a mounting structure 24 for mounting the electronics to the missile airframe 26. In accordance with the present teachings, the mounting structure 24 also contains piezoelectric fiber composite sensor/actuators 30 to tailor the resonance characteristics of the mounting structure 24 to avoid resonance coupling with the electronic components (of the guidance system 18 and seeker 16). In the illustrative embodiment of FIG. 1*a*, the mounting structure 24 is a plate or bulkhead separating the forebody 12 from the warhead and/or rocket motor 14. The guidance system housing 22 is mounted to the mounting structure 24, and the seeker housing 20 is mounted to the guidance system housing 22.

Figure 1B:
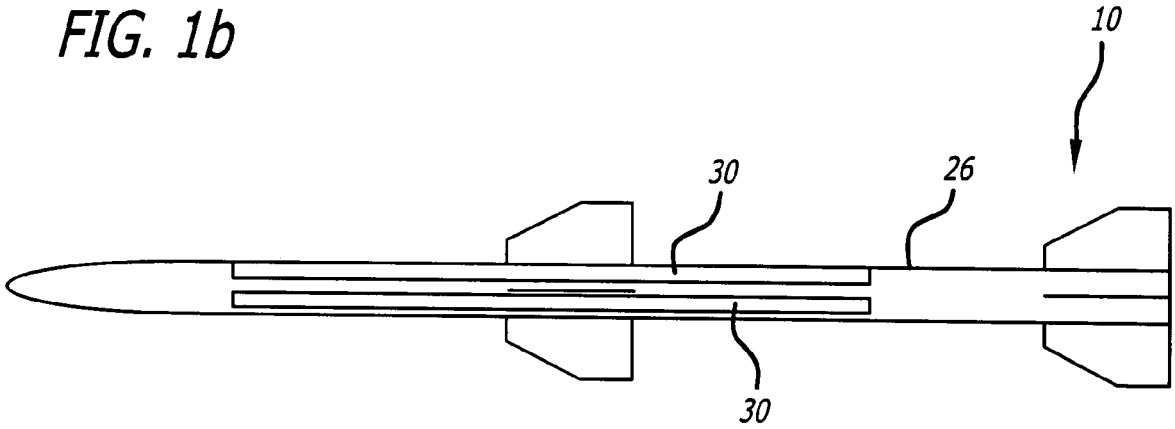
FIG. 1*b* is a simplified diagram of a missile with a layer of piezoelectric fiber composite attached to the missile airframe in accordance with an illustrative embodiment of the present invention.

In a preferred embodiment, the missile airframe 26 itself also contains piezoelectric fiber composite sensor/actuators 30 for electronically tuning airframe stiffness and compliance dynamics. FIG. 1*b* is a simplified diagram of a missile 10 with a layer of piezoelectric fiber composite 30 attached to the missile airframe 26 in accordance with an illustrative embodiment of the present invention.

The piezoelectric fiber composite sensor/actuators 30 perform "self-adjusting" or vibration damping functions. The piezoelectric fiber composite sensor/actuators 30 are adapted to sense changes in motion (i.e., vibrations), which produces an electrical signal that is sent to a control circuit 32. The control circuit 32 measures the magnitude of the change and relays a signal back to the fiber sensor/actuators 30 that either stiffens or relaxes the fiber sensor/actuators 30, producing a self-adjusting or "smart" structure. In an illustrative embodiment, the sensor/actuators 30 and control circuit 32 are designed to stabilize the IMU and seeker from low frequency airframe vehicle loads while attenuating high frequency vibrations from aero-buffeting, stage separation, and rocket vector shock loads. Each vibration controlled component (seeker housing 20, guidance housing 22, mounting structure 24, and airframe 26) may have its own control circuit 30, or a single control circuit 30 may be configured to control vibrations in all of the components.

The vibration controlled components of the present invention may include a layer of piezoelectric fiber composite 30 glued or otherwise attached to the structure (as shown in FIG. 1*b*), or, in the preferred embodiment, the component is fabricated using the piezoelectric fiber composite 30, such that the piezoelectric fibers are embedded within the structure itself (as shown in FIG. 1*a*).

Figure 2A:
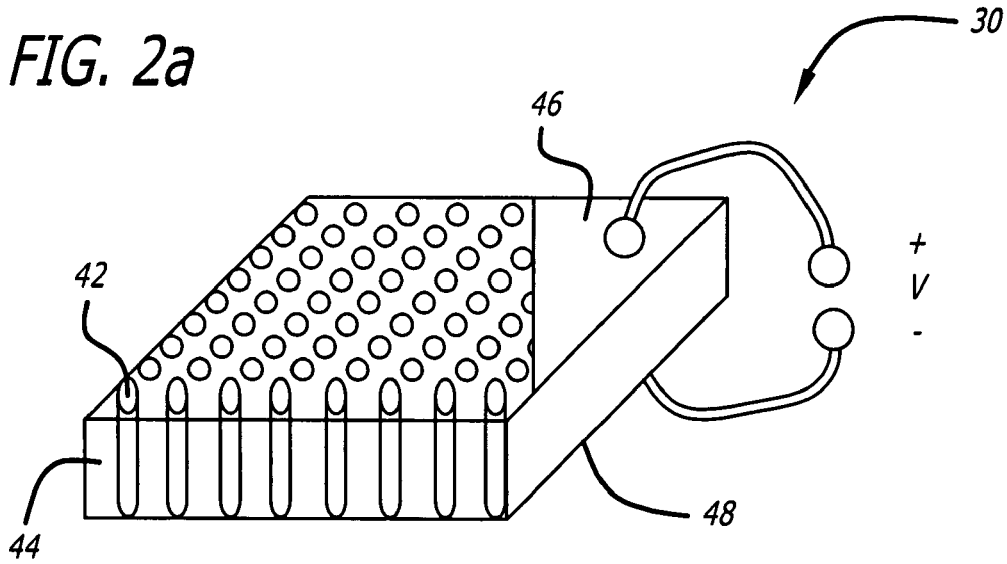
FIG. 2*a* is a simplified diagram of a section of an illustrative piezoelectric fiber composite sensor/actuator that can be used in a vibration controlled component of the present teachings.
Figure 2B:
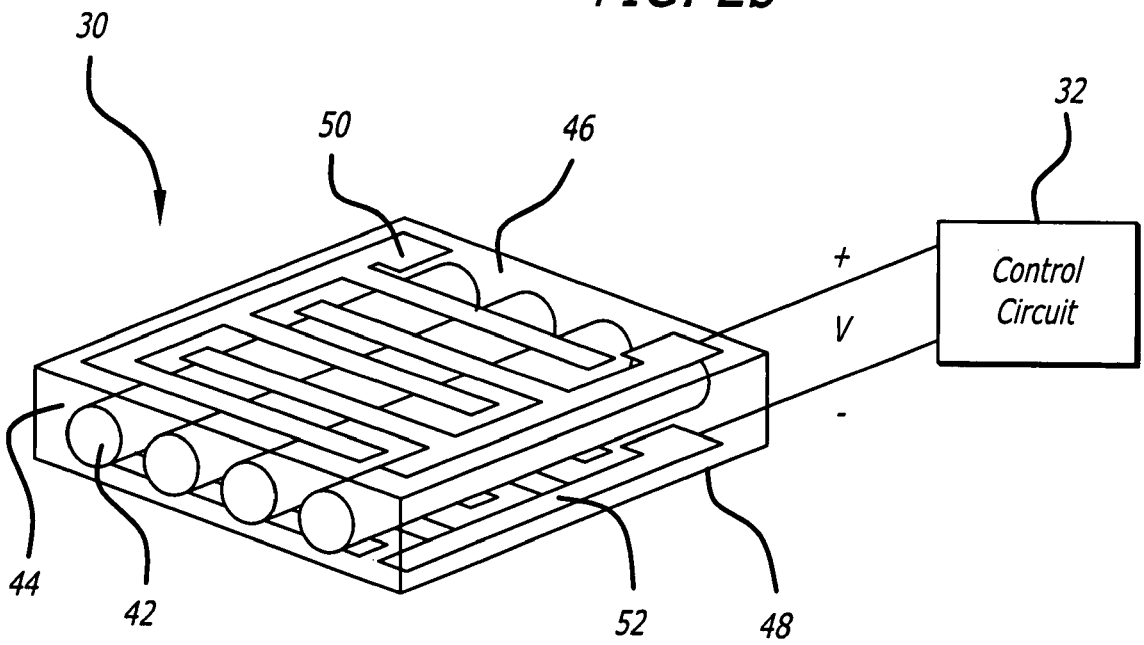
FIG. 2*b* is a simplified diagram of a section of an alternative piezoelectric fiber composite sensor/actuator that can be used in a vibration controlled component of the present teachings.

FIG. 2*a* is a simplified diagram of a section of an illustrative piezoelectric fiber composite sensor/actuator 30 which can be used in a vibration controlled component of the present teachings. FIG. 2*b* is a simplified diagram of a section of an alternative piezoelectric fiber composite sensor/actuator 30 which can be used in a vibration controlled component of the present teachings. The piezoelectric fiber composite 30 includes a plurality of piezoelectric fibers 42 arranged in parallel and surrounded by a matrix material 44 such as a resin or epoxy. The composite 30 includes two opposing active surfaces 46 and 48. A first electrode 50 is disposed on the first active surface 46 and a second electrode 52 is disposed on the second active surface 48. The electrodes 50 and 52 are coupled to the control circuit 32. In the illustrative embodiment, the electrodes 50 and 52 are interdigital electrodes (as shown in FIG. 2*b*). The piezoelectric fibers 42 may be aligned normal to the active surfaces 46 and 48, as shown in FIG. 2*a*, or they may be aligned parallel to the active surfaces 46 and 48, as shown in FIG. 2*b*, or they may be aligned at an angle to the active surfaces 46 and 48. In an illustrative embodiment, the piezoelectric fibers 42 are PZT (lead zirconium titanate) ceramic fibers made with relaxor materials.

Methods for fabricating piezoelectric fiber composites are known in the art. See for example, U.S. Pat. No. 6,620,287, entitled "LARGE-AREA FIBER COMPOSITE WITH HIGH FIBER CONSISTENCY", the teachings of which are incorporated herein by reference. Known methods for manufacturing composite structures can be used to integrate piezoelectric fibers into missile components at low cost.

The piezoelectric fibers 42 will produce a current when deformed or flexed (i.e., by missile vibrations), and conversely will flex when exposed to an electric current or field. The electrodes 50 and 52 are adapted to sense an electrical signal generated in the fibers 42 and also to apply an electrical signal from the control circuit 32 to the fibers 42.

The control circuit 32 generates an electrical actuator signal that is applied to the fibers 42 by the electrodes 50 and 52. The fibers 42 flex in response to the signal, introducing a strain in the structure. Thus, by controlling the voltage of the actuator signal that is applied to the fibers 42, one can control the stiffness of the structure, and also adjust the frequency response of the structure. In addition, the control circuit 32 may be configured to provide active vibration damping by receiving a sensed signal from the fibers 42 and modulating the signal to form an actuator signal that is returned to the fibers 42 to dampen vibrations.

Figure 3:
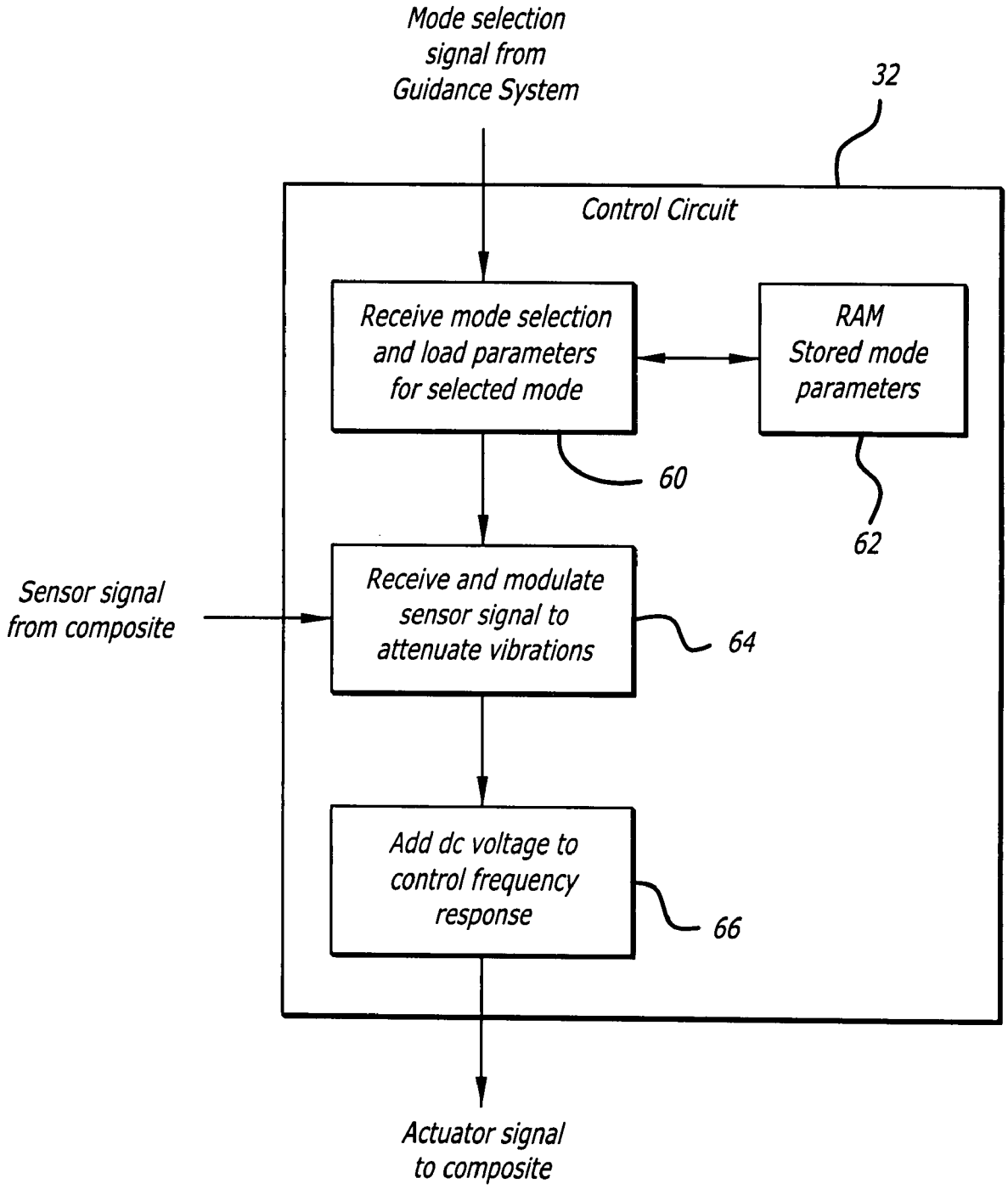
FIG. 3 is a simplified block diagram of a vibration control circuit designed in accordance with an illustrative embodiment of the present invention.

FIG. 3 is a simplified block diagram of a vibration control circuit 32 designed in accordance with an illustrative embodiment of the present invention. In the illustrative embodiment, the control circuit 32 is configured to include a plurality of preprogrammed modes of operation, each mode generating a different actuator signal depending on a mode selection signal provided by the guidance system of the missile. The mode selection signal indicates what operational phase the missile is in (for example, pre-launch, booster phase, guided flight, etc.).

The structural response of the vibration controlled components can therefore be changed to adapt to different environmental conditions. For example, in certain applications, the guidance system does not take over navigation of the missile until after the booster phase. Providing a rigid platform for the IMU and seeker sensors is therefore not as important as protecting electronics during the booster phase (and also during handling before launch) when the guidance system is not controlling navigation. During this period, the control circuit 32 can be configured to generate an actuator signal that reduces stiffness of the fibers 42 and attenuates vibrations, particularly at frequencies harmful to the electronics (e.g., high frequencies). When the guidance system is about to take over navigation control, the control circuit 32 can then switch to a "guidance mode", generating an actuator signal adapted to increase the stiffness of the fibers 42 to provide a stable platform. In addition, by applying actuator signals to the components at appropriate dc voltage levels, the frequency responses of the components can be controlled, for example, to avoid modal coupling between structures or to attenuate vibrations at frequencies that could be detrimental to the guidance system.

In addition, certain events such as stage separations and divert propulsion thrusts can produce large shock loads that render IMU and/or seeker sensor readings unreliable. During these events—which are typically very short, on the order of a few milliseconds, it may be advantageous to turn off the guidance system and disregard the unreliable readings. The control circuit 32 can then be switched to a mode adapted to mitigate these shock loads. After the shock event is over, the control circuit 32 can then switch back to the guidance mode.

In the illustrative embodiment shown in FIG. 3, the control circuit 32 includes logic 60 for receiving the mode selection signal from the guidance system and loading the parameters associated with the selected mode from memory 62. These parameters define what actuator signal should be generated (e.g., the dc voltage component, how the sensor signal should be modulated for active vibration damping, etc.). In the illustrative embodiment, the parameters for each mode are determined during missile testing and then stored on a RAM module 62.

The control circuit 32 also includes logic 64 for receiving a sensor signal measuring the amplitude and frequency of vibrations in the component, and modulating the sensor signal to form an actuator signal adapted to attenuate the sensed vibrations. The actuator signal may simply be an out-of-phase version of the sensed signal, or it may be adapted to focus on attenuating vibrations in particular frequency ranges. The sensor signal may be provided by the piezoelectric fibers 42, which generate an electrical signal when a vibration is applied to them. Alternatively, a separate sensor—which may also be a piezoelectric sensor—may be attached to the structure to measure vibrations.

The control circuit 32 also includes logic 66 for adding a dc voltage component to the actuator signal. The dc voltage increases or decreases the stiffness of the fibers 42 and controls the frequency response of the structure as appropriate for the selected mode. The final actuator signal is then applied to the fibers 42.

The control circuit 32 may be configured to return a finely tuned excitation signal designed to focus on certain frequencies or frequency ranges for vibration attenuation. In an illustrative embodiment, the control circuit 32 may be configured to return an excitation signal adapted to increase compliance of the fibers 42 at high frequencies to provide high frequency vibration isolation to protect electronics, while at the same time increase stiffness of the fibers 42 at low frequencies to provide low frequency stiffness and strength performance to achieve guidance system IMU and seeker alignment constraints. The excitation signal may also be designed to attenuate certain resonance modes, counter modal coupling phenomena, and to attenuate seeker LOS jitter and smearing. Captive carry loads due to aircraft flight environments may also be attenuated by tuning the missile components to dampen the fundamental bending mode for vibration suppression.

In a preferred embodiment, the control circuit 32 is implemented in a small, interlaminated IC chip. The control circuit 32 may be implemented using, for example, discrete logic circuits, FPGAs, ASICs, etc. Alternatively, the control circuit 32 may be implemented in software executed by a microprocessor. Other implementations can also be used without departing from the scope of the present teachings.

Since the piezoelectric fiber composite 30 self-generates an electric pulse during vibration, the control circuit 32 does not require an external power supply. If, however, a higher power excitation signal is desired, a battery may be added to supply additional power to the control circuit 32.

Thus, the present teachings provide vibration control using missile components with piezoelectric fiber composites controlled by an integrated circuit adapted to dynamically tune the frequency responses of the structures. Extensive and iterative structural dynamic analyses, as in prior art applications, will no longer be required, since optimized tuning of the forebody dynamics can be simply programmed into the control chip for any frequency modulation change and readily implemented. During a typical missile development effort, the desired frequency performance of a structural component may be changed due to simulation optimization studies, guidance software and payload hardware performance characterization changes, environmental load design evolutions, and test input revisions. In the past, this usually required system design changes, including complete redesigns of several assemblies. The teachings of the present invention allow for changes to be made to the structural dynamics of the system by modifying the software within the vibration control circuit to shift frequency coupling performance parameters, instead of physically altering the structure (as in the prior art).

This attenuation method can be integrated into the electronics housings of the seeker and guidance system to protect electronics from high frequency vibrations while providing a stable platform for sensitive seeker and IMU equipment. It can also be integrated into bulkheads and mounting structures for further attenuation of electronics vibrations for avionic and seeker housing weight reductions, instead of adding heavy structural reinforcements, passive damping mounts (i.e. rubber mounts or dash-pods), or active tuning mechanisms (such as seeker steering mirrors) to achieve the same dynamic performance. In addition, integrating piezoelectric fiber composite technology into the missile airframe improves the airframe structural performance, and provides the ability to electronically tailor missile airframe frequency responses.

Figure 4:
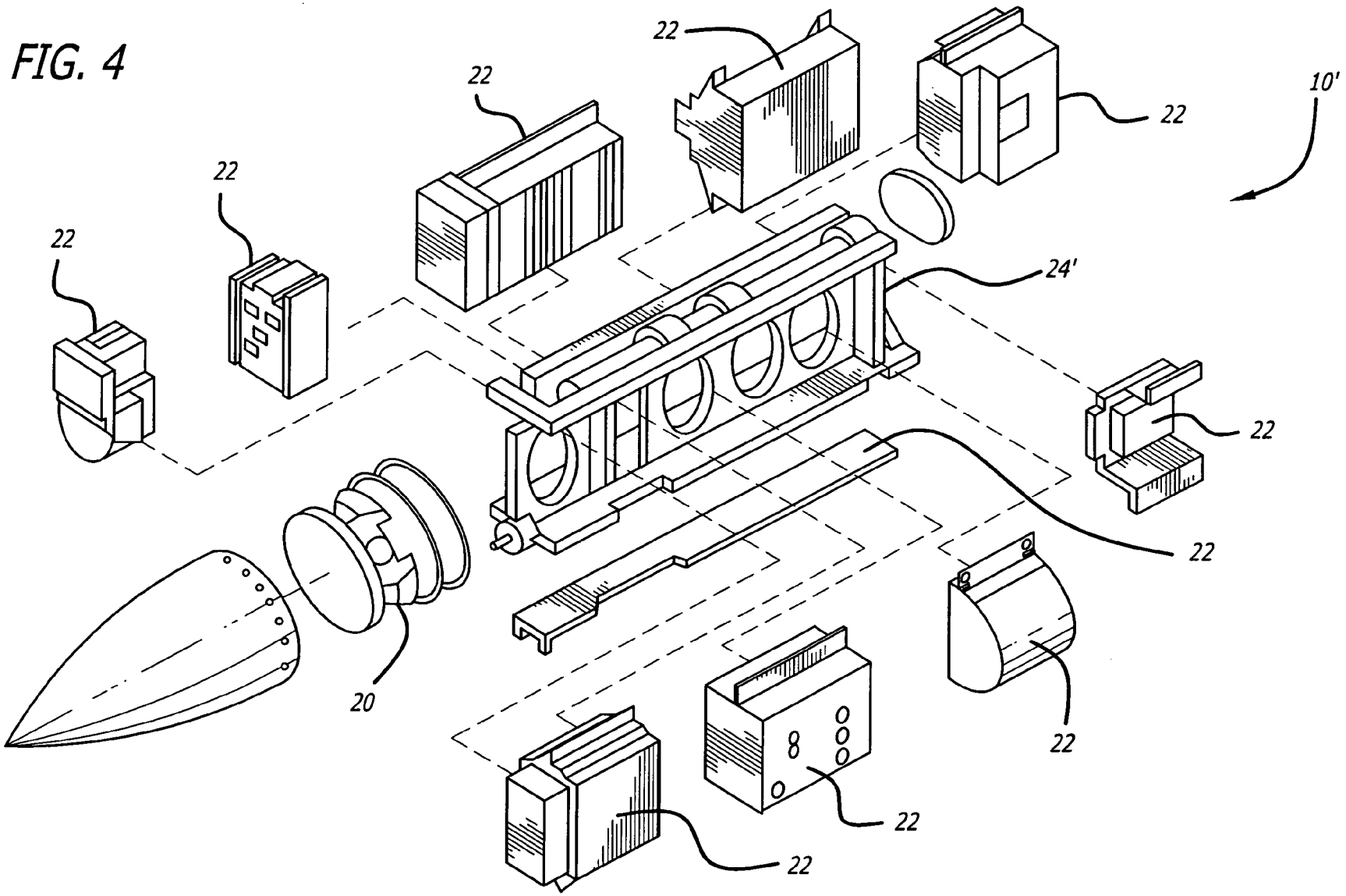
FIG. 4 is an exploded view of an illustrative missile with vibration controlled components designed in accordance with an alternative embodiment of the present invention.

The teachings of the present invention can be applied to any type of missile. FIGS. 1, 4, and 5 show different illustrative missile designs using vibration controlled components designed in accordance with the present teachings. FIGS. 1*a* and 1*b* showed a design that might be used in an air-to-air or surface-to-air missile. FIG. 4 shows an alternate design that might be used in an air-to-air or surface-to-air missile, such as an ESSM (Evolved Sea Sparrow Missile), and FIGS. 5*a*-5*e* show a design that might be used in a Kinetic Energy Interceptor (KED) missile.

FIG. 4 is an exploded view of an illustrative missile 10' with vibration controlled components designed in accordance with an alternative embodiment of the present invention. In this embodiment, the missile 10' includes a mounting structure 24' which is an axial beam attached to the missile airframe (not shown). The mounting beam 24' and missile airframe both contain piezoelectric fiber composite sensor/actuators in accordance with the teachings of the present invention. A plurality of electronic components, each housed in a vibration controlled electronics housing 22 containing piezoelectric fiber composite sensor/actuators, are mounted to the mounting beam 24'. A seeker housing 20 containing piezoelectric fiber composite sensor/actuators is also mounted to the mounting beam 24'.

Figure 5A:
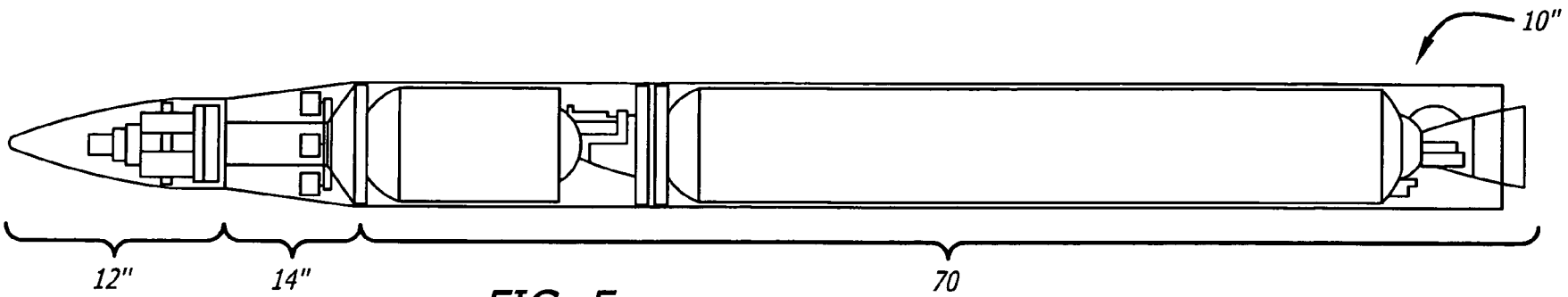
FIG. 5*a* is a cross-sectional view of a Kinetic Energy Interceptor (KEI) missile with vibration controlled components designed in accordance with an alternative embodiment of the present invention.

FIG. 5*a* is a cross-sectional view of a Kinetic Energy Interceptor (KEI) missile 10" with vibration controlled components designed in accordance with an alternative embodiment of the present invention. A KEI missile is configured to intercept enemy missiles during their boost phase, prior to mid-course ballistic ascent where the payload is uncovered and any RVs and possible decoys are deployed. Booster phase interception also implies that any toxic materials dispersed during interception whether nuclear, biological, or nerve gas agents would fall back onto the country of origin with minimal liability to the defending forces positioned in the region. Time-to-target is critical to the KEI mission; therefore high performance, lightweight airframe and electronics package technologies are needed to maximize Interceptor agility. As shown in FIG. 5*a*, the KEI missile 10" includes a two-stage booster 70, a third-stage rocket motor 14", and a kill vehicle 12".

Figure 5B:
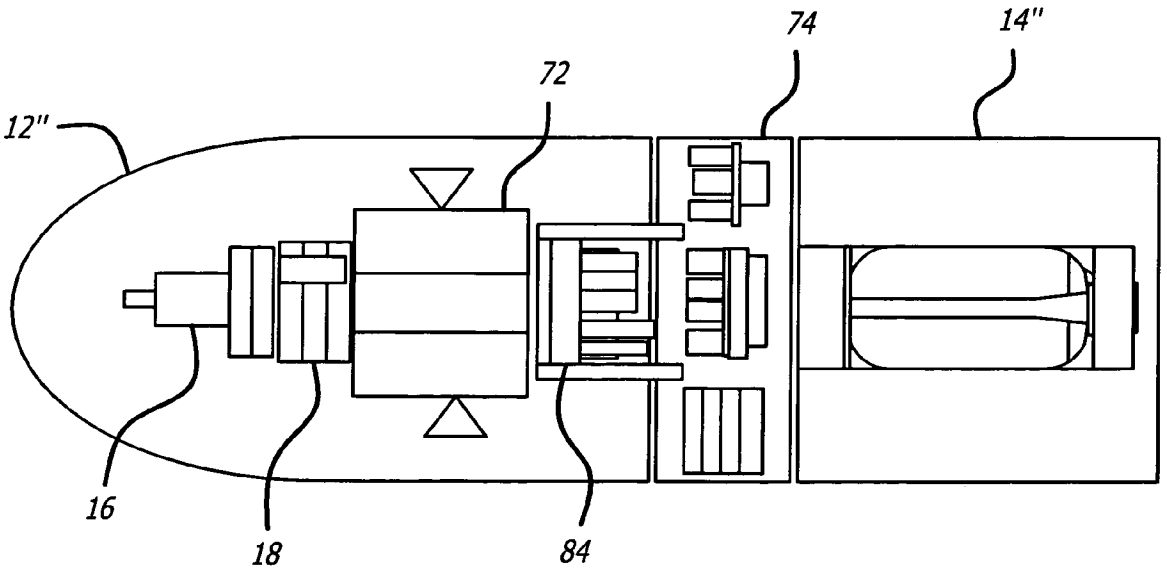
FIG. 5*b* is a simplified schematic of the kill vehicle and rocket motor of the illustrative KEI missile of FIG. 5*a*.

FIG. 5*b* is a simplified schematic of the kill vehicle 12" and rocket motor 14" of the KEI missile 10" of FIG. 5*a*. The kill vehicle 12" includes a seeker assembly 16, guidance system electronics 18, and a lateral propulsion system 72. The kill vehicle 12" components are attached to the rocket motor 14" by an interstage adapter structure 74.

Figure 5C:
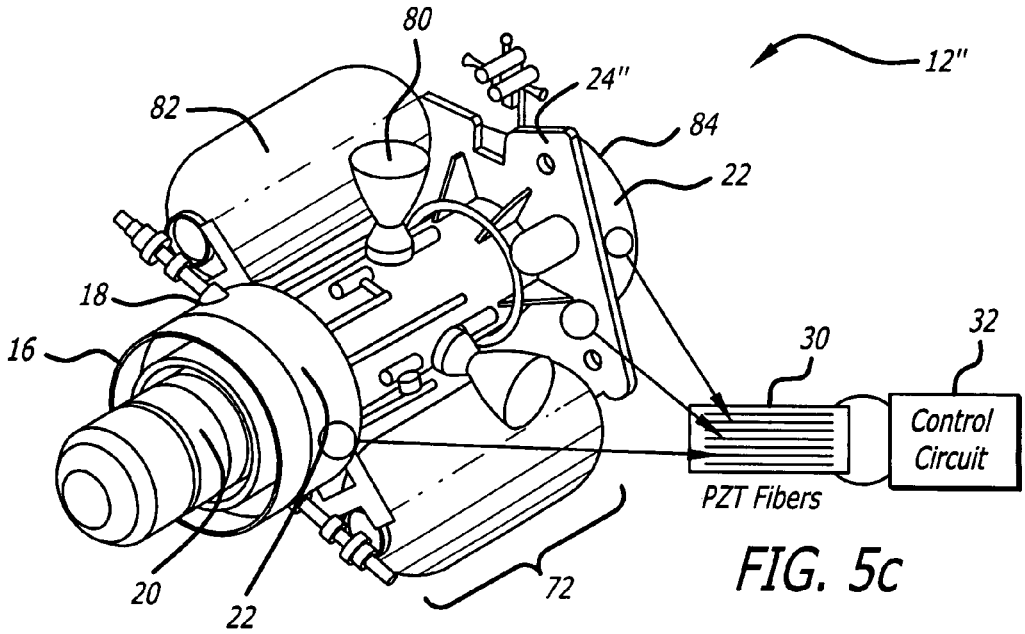
FIG. 5*c* is a three-dimensional view of the internal components of the kill vehicle with vibration controlled components designed in accordance with an illustrative embodiment of the present invention.

FIG. 5*c* is a three-dimensional view of the internal components of the kill vehicle 12". The kill vehicle 12"includes a lateral propulsion system 72, which includes a plurality of nozzles 80 and bottles of fluid 82 attached to a mounting structure 24". A forward electronics assembly 18, which includes the IMU and guidance system electronics, is attached to the forward end of the mounting structure 24". The seeker assembly 16 is attached to the forward electronics assembly 18. An aft electronics assembly 84 is attached to the rear of the mounting structure 24". The mounting structure 24" is attached to the interstage adaptor 74.

Figure 5D:
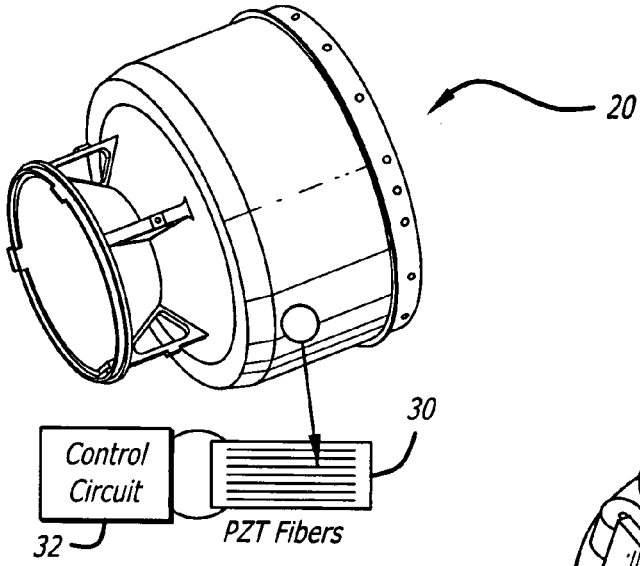
FIG. 5*d* is a three-dimensional view of a seeker housing designed in accordance with an illustrative embodiment of the present teachings.

In accordance with the present teachings, the mounting structure 24" and missile airframe (not shown) each contain piezoelectric fiber composite sensor/actuators 30 and a control circuit 32 adapted to tune the structural responses of the components to provide a stable platform for the seeker and IMU while attenuating high frequency vibration. The forward electronics assembly 18 and aft electronics assembly 84 are each housed in an electronics housing 22 containing piezoelectric fiber composite sensor/actuators 30 and a control circuit 32 adapted to dampen vibrations in the electronics assemblies. The seeker assembly 16 includes a seeker housing 20, which also contains piezoelectric fiber composite sensor/actuators 30 and a control circuit 32 for providing a stable platform for the seeker components while attenuating vibrations. FIG. 5*d* is a three-dimensional view of a seeker housing 20 designed in accordance with an illustrative embodiment of the present teachings.

Figure 6A:
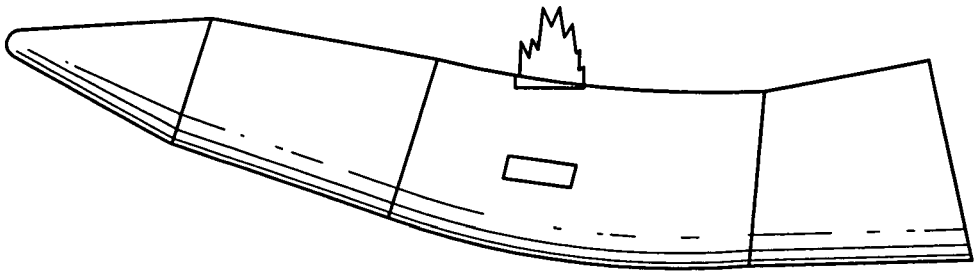
FIG. 6*a* is an illustration showing the missile bending such that its LOS is at an angle relative to the rigid body line of the missile.
Figure 6B:
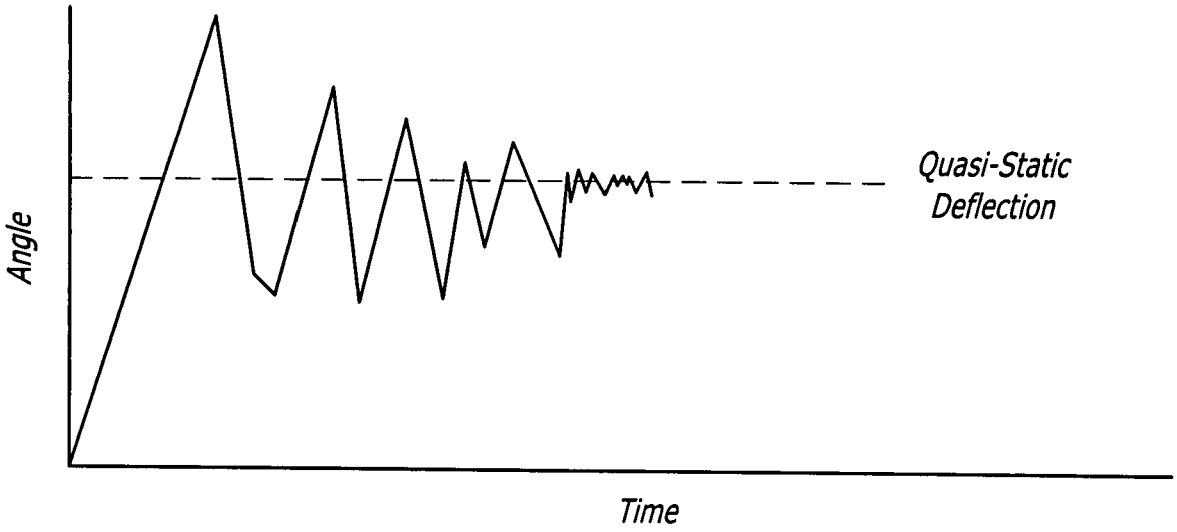
FIG. 6*b* is a graph of the missile bending angle versus time.

Divert thrust forces generated by the propulsion system 72 can cause jitter and smear dynamics that affect seeker resolution and missile guidance and navigation. FIG. 6*a* is an illustration showing the missile bending such that its LOS is at an angle $\Delta\Theta_S$ relative to the rigid body line of the missile. FIG. 6*b* is a graph of the missile bending angle versus time. In accordance with the present teachings, the vibration controlled components may also be adapted to mitigate LOS jitter and smearing that occur during propulsion ignition.

Figure 5E:
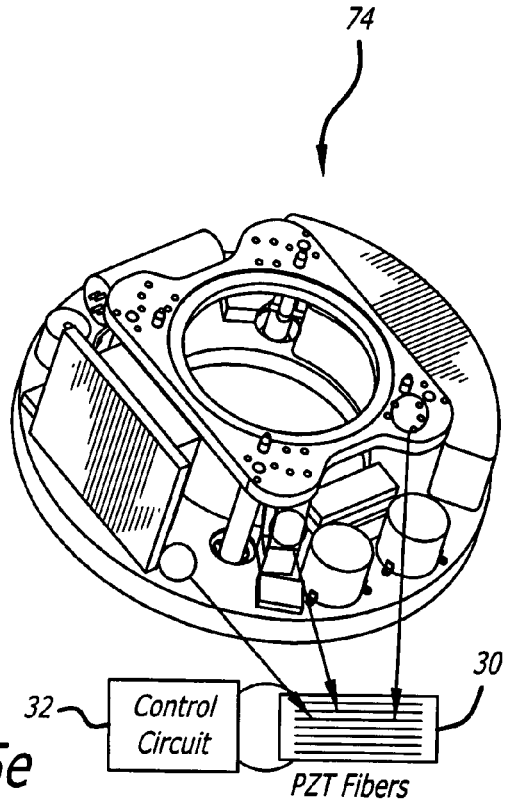
FIG. 5*e* is a three-dimensional view of an illustrative interstage adapter designed in accordance with an illustrative embodiment of the present teachings.

FIG. 5*e* is a three-dimensional view of an illustrative interstage adapter 18. The KEI interstage adaptor 74 serves many functions as a transition structure between the kill vehicle 12" and the booster stack-up. Although it is not a large structure, it should be lightweight since burnout velocity is very sensitive to weight at the front end of the interceptor. It should also be sufficiently strong and stiff to preclude excessive deflection within the kill vehicle sway space, assuring it does not impact the enveloping nosecone.

In accordance with the present teachings, the interstage adaptor 74 also contains piezoelectric fiber composite sensor/actuators 30 and a control circuit 32 adapted to attenuate vibrations traveling to the kill vehicle 12" and reduce the shock and vibration environment severity for the kill vehicle 12". In addition, resonance characteristics can be tailored to avoid kill vehicle/adapter resonance coupling. Most importantly, the adaptor structure 74 can be electronically tuned to provide sufficient airframe stiffness between the kill vehicle and interceptor booster to allow IMU functionality, while compliant enough to attenuate high frequency loads from damaging sensitive kill vehicle electronics and seeker assemblies.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A housing comprising:

a housing structure having a plurality of piezoelectric fibers disposed on or within;

a control circuit to generate a control signal for electronically tuning a structural response of the structure in response to a sensor signal provided by the piezoelectric fibers, wherein the piezoelectric fibers are adapted to generate the sensor signal in response to a deformation in the housing structure, wherein the piezoelectric fibers are further adapted to deform the structure in response to the control signal to tune the structural response of the structure.

2. The housing of claim 1 wherein the piezoelectric fibers are configurable to increase or decrease stiffness of the structure in response to the control signal, and wherein at least some of the piezoelectric fibers that generate the sensor signal in response to the deformation include the same piezoelectric fibers that deform the structure in response to the control signal.

3. The housing of claim 1 wherein the control circuit is configured to generate the control signal to cause the piezoelectric fibers to tune a frequency response of the structure based on frequency components of the sensor signal.

4. The housing of claim 1 wherein the control circuit includes a plurality of operational modes, each operational mode adapted to generate a different control signal for providing a different structural response, wherein the operational modes comprise a booster mode and a guidance mode, wherein during the booster mode, the control circuit is configured to generate a control signal to reduce stiffness by increasing compliance of the piezoelectric fibers to attenuate vibrations at higher frequencies, and wherein during the guidance mode, the control circuit is configured to generate a control signal to increase stiffness of the piezoelectric fibers at lower frequencies.

5. The housing of claim 4 wherein during the booster mode, the control circuit is configured to generate the control signal to attenuate vibrations at higher frequencies by modulating the control signal based on vibrations sensed by the fibers.

6. The housing of claim 5 wherein the control circuit is configured to switch to the guidance mode just prior to a guidance system taking over navigational control.

7. The housing of claim 6 wherein the operational modes further include a stage separation mode, wherein during the stage separation mode, the control circuit is configured generate a control signal to mitigate shocks associated with stage separation.

8. The housing of claim 1 wherein the piezoelectric fibers are embedded in a composite material attached to the structure.

9. The housing of claim 1 wherein the structure is fabricated from a composite material including the piezoelectric fibers.

10. The housing of claim 1 wherein the plurality of piezoelectric fibers comprise one or more electrodes to provide the sensor signal to the control circuit and for the control circuit to provide the control signal to the piezoelectric fibers, and wherein the control circuit includes logic for generating the control signal adapted to attenuate vibrations in the structure at predetermined frequencies.

11. The housing of claim 10 wherein the control circuit includes logic for generating the control signal adapted to increase stiffness or compliance of the fibers at predetermined frequencies.

12. The housing of claim 11 wherein the control signal is adapted to increase compliance of the fibers at high frequencies to dampen high frequency vibrations to which equipment housed within the structure is sensitive.

13. The housing of claim 12 wherein the control signal is also adapted to increase stiffness of the fibers at low frequencies such that the structure provides a stable platform for equipment housed within the structure.

14. The housing of claim 10 wherein the fibers are also adapted to sense motion in the structure and in response thereto generate a sensor signal.

15. The housing of claim 14 wherein the control circuit is adapted to modulate the sensor signal to generate a control signal adapted to attenuate vibrations sensed by the sensor signal.

16. The housing of claim 10 wherein the control circuit includes a plurality of operational modes, each mode adapted to generate a different control signal for providing a different structural response, wherein the operational modes comprise a booster mode and a guidance mode, wherein during the booster mode, the control circuit is configured to generate the control signal to reduce stiffness by increasing compliance of the fibers to attenuate vibrations at higher frequencies by modulating the control signal based on vibrations sensed by the fibers, and wherein during the guidance mode, the control circuit is configured to generate the control signal to increase stiffness of the fibers at lower frequencies.

17. The housing of claim 16 wherein the control circuit includes means for receiving a signal for selecting one of the operational modes and in accordance therewith generating the control signal corresponding to the selected mode.

18. The housing of claim 1 wherein the housing is an electronics housing.

19. The housing of claim 1 wherein the housing is a missile airframe.

20. An electronics housing comprising:

a housing structure fabricated from a composite material containing a plurality of piezoelectric fibers adapted to generate an electrical signal in response to a deformation in the structure and to deform the structure in response to an excitation signal applied thereto and a control circuit configured to receive the electrical signal from the fibers, to modulate the electrical signal to form an excitation signal adapted to increase stiffness or compliance of the fibers at predetermined frequencies to tune a frequency response of the structure, and to apply the excitation signal to the fibers, wherein the electrical signal includes frequency components associated with the deformation of the structure and the control circuit generates the excitation signal to tune the frequency response of the structure based on the frequency components.

21. A control circuit for controlling vibrations in a structure containing piezoelectric fibers adapted to generate a sensor signal in response to a deformation in the structure and to deform the structure in response to an excitation signal applied thereto, the control circuit comprising:

a first circuit for receiving the sensor signal, the sensor signal including frequency components associated with the deformation of the structure; and a second circuit for modulating the sensor signal to form an excitation signal adapted electronically tune a structural response of the structure based on the frequency components of the sensor signal, wherein at least some of the piezoelectric fibers that generate the sensor signal in response to the deformation are the same piezoelectric fibers that deform the structure in response to the excitation signal applied thereto.

22. The control circuit of claim 21 wherein the control circuit includes a plurality of operational modes, each mode adapted to generate a different excitation signal for providing a different structural response, wherein the operational modes comprise a booster mode and a guidance mode, wherein during the booster mode, the second circuit is configured to generate the excitation signal to reduce stiffness by increasing compliance of the fibers to attenuate vibrations at higher frequencies, and wherein during the guidance mode, the second circuit is configured to generate the excitation signal to increase stiffness of the fibers at lower frequencies.

23. The control circuit of claim 22 wherein the control circuit further includes circuitry to receive a signal for selecting one of the operational modes.

* * * * *

UNITED STATES PATENT AND TRADEMARK OFFICE

CERTIFICATE OF CORRECTION

PATENT NO. : 7,767,944 B2
APPLICATION NO. : 11/715034
DATED : August 3, 2010
INVENTOR(S) : Andrew B. Facciano et al.

It is certified that error appears in the above-identified patent and that said Letters Patent is hereby corrected as shown below:

In column 10, line 14, in Claim 7, after "configured" insert -- to --.

Signed and Sealed this

Twenty-eighth Day of September, 2010

David J. Kappos

David J. Kappos
*Director of the United States Patent and Trademark Office*